US011267674B2

(12) United States Patent
Lai

(10) Patent No.: US 11,267,674 B2
(45) Date of Patent: Mar. 8, 2022

(54) STRAP FEEDING DEVICE FOR STRAPPING MACHINE

(71) Applicant: EXPACK INDUSTRIAL CORPORATION, Taichung (TW)

(72) Inventor: Yu-Ting Lai, Taichung (TW)

(73) Assignee: EXPACK INDUSTRIAL. CORPORATION, Taichung (TW)

( * ) Notice: Subject to any disclaimer, the term of this patent is extended or adjusted under 35 U.S.C. 154(b) by 107 days.

(21) Appl. No.: 16/868,947

(22) Filed: May 7, 2020

(65) Prior Publication Data

US 2020/0354186 A1 Nov. 12, 2020

(30) Foreign Application Priority Data

May 10, 2019 (TW) ..... 108205887

(51) Int. Cl.
*B65H 23/10* (2006.01)
*B65H 75/44* (2006.01)

(52) U.S. Cl.
CPC ..... *B65H 75/4428* (2013.01); *B65H 75/4486* (2013.01)

(58) Field of Classification Search
CPC ..... B65H 75/4428; B65H 75/4486; B65H 2701/375; B65H 23/10; B65H 23/063; B65H 23/066
See application file for complete search history.

(56) References Cited

U.S. PATENT DOCUMENTS 5,615,538 A * 4/1997 Miyashita ..... B65B 13/22 53/582
6,293,192 B1 * 9/2001 Bartlett ..... B65H 19/1821 101/212
7,287,717 B2 * 10/2007 Ropers ..... B65H 51/28 242/419.9
2006/0175458 A1 * 8/2006 Ropers ..... B65H 51/28 242/563
2010/0090051 A1 * 4/2010 Groff ..... B65H 59/387 242/414.1

* cited by examiner

*Primary Examiner* — Sang K Kim
(74) *Attorney, Agent, or Firm* — Birch, Stewart, Kolasch & Birch, LLP

(57) ABSTRACT

A strap feeding device includes first driving and driven rollers, second driving and driven rollers, an actuating unit, and a detecting unit. The actuating unit can move the second driving roller between a released position, where the second driven roller is spaced apart from the second driving roller, and a contact, where the second driven roller contacts the second driving roller and is co-rotatable with the second driving roller to clamp and move a strap. The control device controls rotation of the first and second driving rollers to feed and return the strap, detects rotation of the first driven roller, and controls the actuating unit to move the second driven roller to the contact and released positions.

5 Claims, 5 Drawing Sheets

STRAP FEEDING DEVICE FOR STRAPPING MACHINE

CROSS-REFERENCE TO RELATED APPLICATION

This application claims priority of Taiwanese Invention Patent Application No. 108205887, filed on May 10, 2019.

FIELD

The disclosure relates to a feeding machine, more particularly to a strap feeding device for a strapping machine.

BACKGROUND

A conventional feeding device for a strapping machine disclosed in Taiwanese Invention Patent No. 453147 includes a driving roller, a driven roller, a support arm, a lever and a spring. The driving roller cooperates with the driven roller to clamp the strap therebetween so as to feed and return the strap. The driven roller is mounted on the support arm which abuts against one end of the spring. The lever is driven by a cam of a transmission device of the strapping machine to compress the spring such that the support arm is driven by the spring to move the driven roller toward the driving roller so as to clamp the strap between the driving roller and the driven roller. However, the strap may drop down by gravity during a strap returning action.

SUMMARY

Therefore, an object of the disclosure is to provide a strap feeding device that can alleviate the drawback of the prior art.

According to one aspect of the disclosure, a strap feeding device for a strapping machine is provided. The strap feeding device is adapted to feed a strap in a forward direction and to return the strap in a rearward direction when a strap feeding action is failed. The strap feeding device includes a base seat, a main feeding unit, an auxiliary feeding unit, an actuating unit and a detecting unit. The main feeding unit includes a first driving roller, a first driving element, and a first driven roller. The first driving roller is rotatably mounted on the base seat. The first driving element is connected to the first driving roller and is operable for driving the first driving roller to rotate. The first driven roller is rotatably mounted on the base seat and is adapted for cooperation with the first driving roller to clamp the strap therebetween so as to move the strap when the first driving roller rotates. The auxiliary feeding unit is disposed at upstream of the main feeding unit and includes a second driving roller, a second driving element, and a second driven roller. The second driving roller is rotatably mounted to the base seat. The second driving element is connected to the second driving roller and is operable for driving the second driving roller to rotate. The second driven roller is adjacent to the second driving roller. The actuating unit includes a lever and an actuating member. The lever has a pivot end that is pivotally mounted on the base seat, and a movable portion that is mounted with the second driven roller. The actuating member is operable to drive the lever to pivot relative to the base seat so as to move the second driven roller between a released position, where the second driven roller is spaced apart from the second driving roller, and a contact position, where the second driven roller is in contact with the second driving roller and is co-rotatable with the second driving roller. The detecting unit is mounted to the base seat, is adjacent to the main feeding unit, and includes a control device, and a plurality of sensors. The control device is electrically connected to the first driving element, the second driving element and the actuating unit, and is configured to control the first driving element for driving the first driving roller to rotate in a first direction and a second direction opposite to the first direction so as to feed and return the strap, and control the second driving element for driving the second driving roller wheel to rotate in the first direction and the second direction so as to feed and return the strap. The sensors are adjacent to the first driven roller, and are electrically connected to the control device for detecting rotation of the first driven roller. The control device is configured to control the actuating unit to drive the lever to move the second driven roller to the contact position when the sensors detect that rotation of the first driven roller is stopped, and to control the actuating unit to move the second driven roller to the released position when the sensors detect that the first driven roller starts to rotate.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
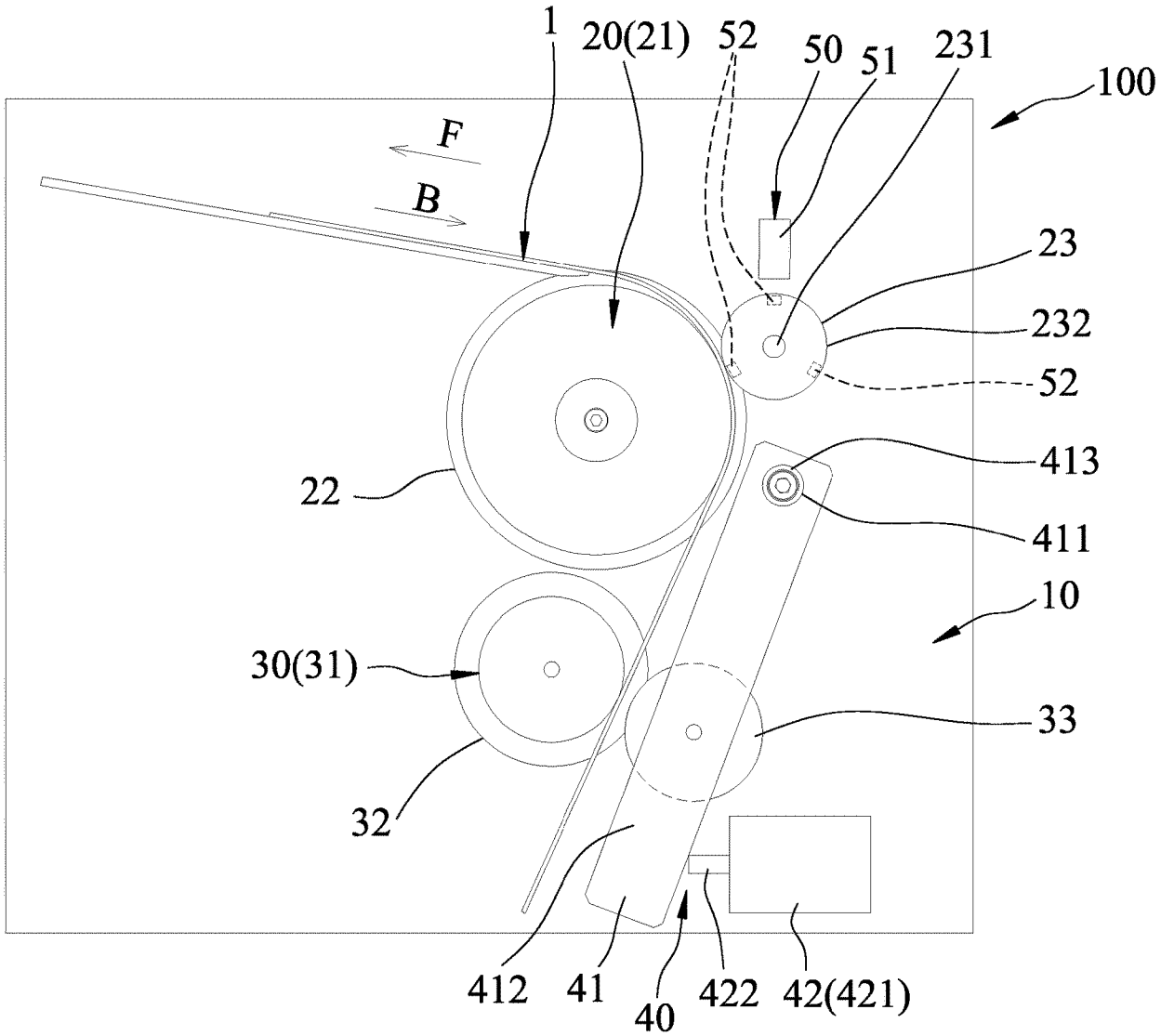
FIG. 1 is a schematic side view of a strap feeding device for a strapping machine according to an embodiment of the present disclosure, illustrating the strap feeding device being operated to feed a strap in a forward direction.

Referring to FIGS. 1 to 4, a strap feeding device 100 for a strapping machine is adapted to feed a strap 1 in a forward direction (F) and to return the strap 1 in a rearward direction (R) when a strap feeding action is failed. The strap feeding device 100 includes abase seat 10, a main feeding unit 20, an auxiliary feeding unit 30, an actuating unit 40 and a detecting unit 50.

The main feeding unit 20 includes a first driving roller 21, a first driving element 22 and a first driven roller 23. The first driving roller 21 is rotatably mounted on the base seat 10. The first driving element 22 is connected to the first driving roller 21 and is operable for driving the first driving roller 21 to rotate. The first driven roller 23 is rotatably mounted on the base seat 10 about an axis 231 and is adapted for cooperation with the first driving roller 21 to clamp the strap 1 therebetween so as to move the strap 1 when the first driving roller 21 rotates.

The auxiliary feeding unit 30 is disposed at upstream of the main feeding unit 20 and includes a second driving roller 31, a second driving element 32 and a second driven roller 33. The second driving roller 31 is rotatably mounted to the base seat 10. The second driving element 32 is connected to the second driving roller 31 and is operable for driving the second driving roller 31 to rotate. The second driven roller 33 is adjacent to the second driving roller 31.

The actuating unit 40 includes a lever 41 and an actuating member 42. The lever 41 has a pivot end 411 that is pivotally mounted on the base seat 10, and a movable portion 412 that is mounted with the second driven roller 33. The actuating member 42 is operable to drive the lever 41 to pivot relative to the base seat 10 so as to move the second driven roller 33 between a released position (see FIGS. 1 and 2), where the second driven roller 33 is spaced apart from the second driving roller 31, and a contact position (see FIGS. 3 and 4), where the second driven roller 31 is in contact with the second driving roller 31 and is co-rotatable with the second driving roller 31.

In this embodiment, the actuating unit 40 is a solenoid valve. The actuating member 42 includes a cylinder 421 and a push rod 422 mounted movably to the cylinder 421 and movable to push and rotate the lever 41 relative to the base seat 10 so as to move the second driven roller 33 from the released position to the contact position when the actuating member 42 is activated. The lever 41 is inclined such that a free end of the lever 41 is pivoted by virtue of gravity to contact an end of the push rod 422 so that the second driven roller 33 is moved back to the released position when the actuating member 42 is deactivated.

In this embodiment, to facilitate the second driven roller 33 to move from the contact position to the released position, the actuating unit 40 further includes a biasing member 413 for pivoting the lever 41 away from the second driving roller 31, so that the second driven roller 33 is biased away from the second driving roller 31 when the actuating member 42 is deactivated. In this embodiment, the biasing member 413 is a torsion spring. Alternatively, the biasing member 413 may be omitted.

Figure 5:
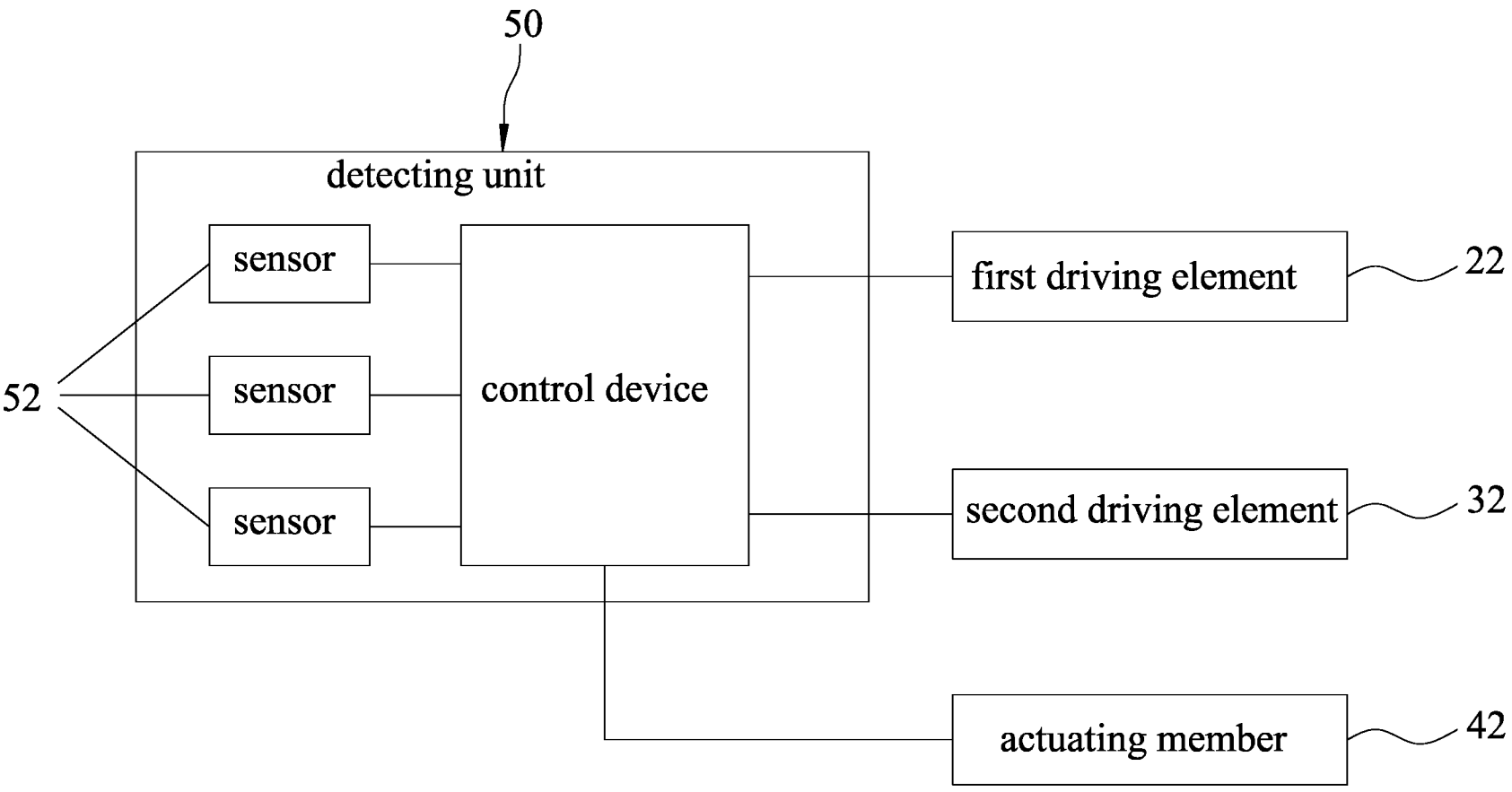
FIG. 5 is a schematic block diagram of the embodiment, illustrating a detecting unit electrically connected to the main feeding unit, the auxiliary feeding unit and the actuating unit.

The detecting unit 50 is mounted to the base seat 10, is adjacent to the main feeding unit 20, and includes a control device 51 and a plurality of sensors 52. Further referring to FIG. 5, the control device 51 is electrically connected to the first driving element 22, the second driving element 32 and the actuating unit 40, and is configured to control the first driving element 22 for driving the first driving roller 21 to rotate in a first direction and a second direction opposite to the first direction so as to feed and return the strap 1, control the second driving element 32 for driving the second driving roller wheel 31 to rotate in the first direction and the second direction so as to feed and return the strap 1, and control the actuating member 42 of the actuating unit 40 to be activated and deactivated. In this embodiment, the first direction is counterclockwise direction and the second direction is clockwise direction.

The sensors 52 are mounted adjacent to the first driven roller 23, and are electrically connected to the control device 51 for detecting rotation of the first driven roller 23. In this embodiment, the sensors 52 are angularly spaced apart from one another, are mounted on a peripheral position 232 of the first driven roller 23, and are configured to respectively emit sensing signals to be received by the control device 51 when being disposed at a certain position, e.g., when passing by the control device 51. The control device 51 is configured to determine whether the first driven roller 23 is rotating according to the sensing signals emitted by the sensors 52. For example, the sensors 52 are magnets and the control device 51 includes a Hall effect sensor for proximity sensing of the magnets but the implementations of the sensors and the control device 51 are not limited to the example described herein. Since the main feature of the present disclosure does not reside in how the control device 51 determines whether the first driven roller 23 is rotating, any techniques capable of determining rotation of an object may be employed to determine whether the first driven roller 23 is rotating.

The control device 51 is configured to activate the actuating unit 40 to drive the lever 41 to move the second driven roller 33 to the contact position when the sensors 52 detect that rotation of the first driven roller 23 is stopped, and to deactivate the actuating unit 40 to move the second driven roller 33 to the released position when the sensors 52 detect that the first driven roller 23 starts to rotate. The control device 5 may be implemented with a microprocessor, a micro control unit (MCU), or any circuit configurable/programmable in a software manner and/or hardware manner to perform functionalities of this disclosure. For example, the control device 5 includes, but not limited to, one or more of a single core processor, a multi-core processor, a dual-core mobile processor, a microprocessor, a microcontroller, a digital signal processor (DSP), a field-programmable gate array (FPGA), an application specific integrated circuit (ASIC), a radio-frequency integrated circuit (RFIC), etc.

The operation of the strap feeding device 100 of the embodiment is described in the following. To feed the strap 1, as shown in FIG. 1, the first driving element 22 is controlled by the control device 51 to drive the first driving roller 21 to rotate in the first direction such that the first driven roller 23 cooperating with the first driving roller 21 to clamp the strap 1 therebetween is driven to rotate in the second direction so as to feed the strap 1 in the forward direction (F). At this time, the control device 51 detects that the first driven roller 23 is rotating and the actuating member 42 is deactivated, such that the second driven roller 33 remains at the released position and is spaced apart from the second driving roller 31.

Figure 2:
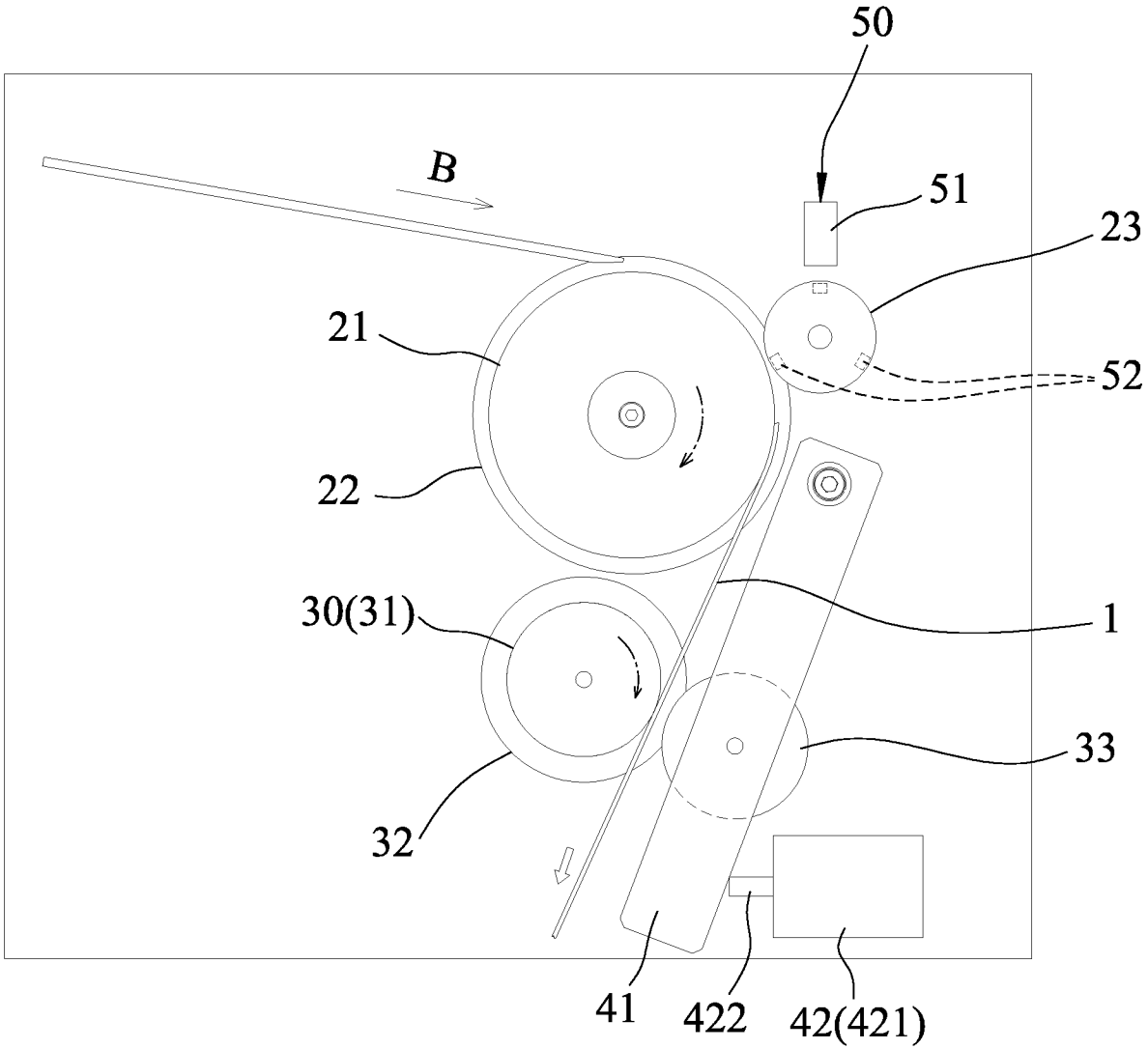
FIG. 2 is a schematic side view of the embodiment, illustrating the strap feeding device being operated to return a strap in a rearward direction.
Figure 3:
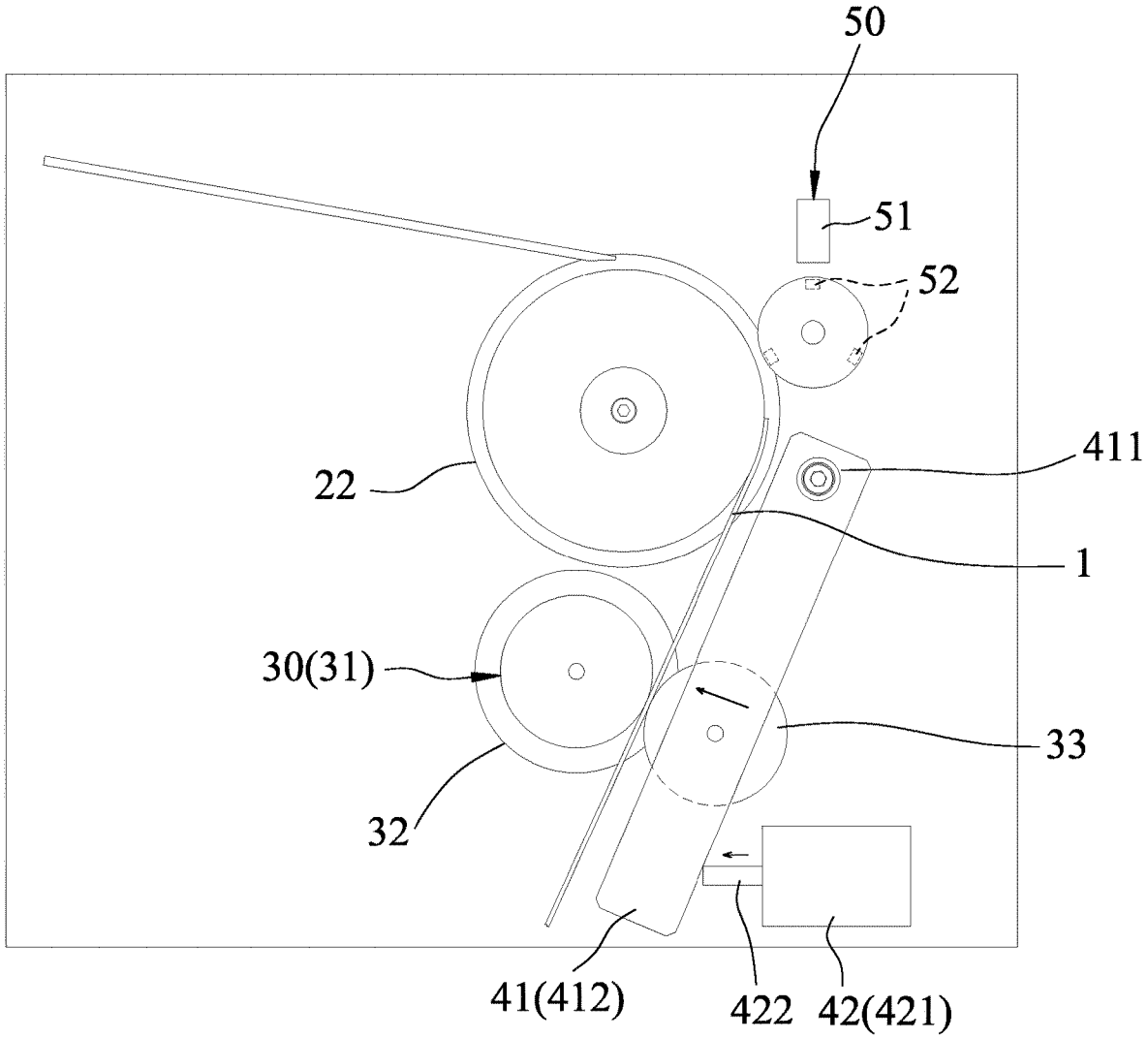
FIG. 3 is a schematic side view of the embodiment, illustrating an actuating unit operable to clamp the strap between driving and driven rollers of the auxiliary feeding unit.

When the strap feeding action is failed, the first first driving roller 21 is driven to rotate in the second direction as illustrated in FIG. 2 so as to return the strap 1 in the rearward direction (R). Once the strap 1 is removed from the gap between the first driving roller 21 and the first driven roller 23, rotation of the first driven roller 23 is stopped and is detected by the control device 51. Subsequently, as shown in FIG. 3, the actuating member 42 is activated by the control device 51 and the push rod 422 moves relative to the cylinder 421 to push and rotate the lever 41 relative to the base seat 10. Thus, the second driven roller 33 mounted on the movable portion 412 of the lever 41 is moved from the released position to the contact position so as to be in contact with the second driving roller 31. In this way, the strap 1 is clamped between the second driving roller 31 and the second driven roller 33 and would not drop down by gravity during the strap returning action.

Figure 4:
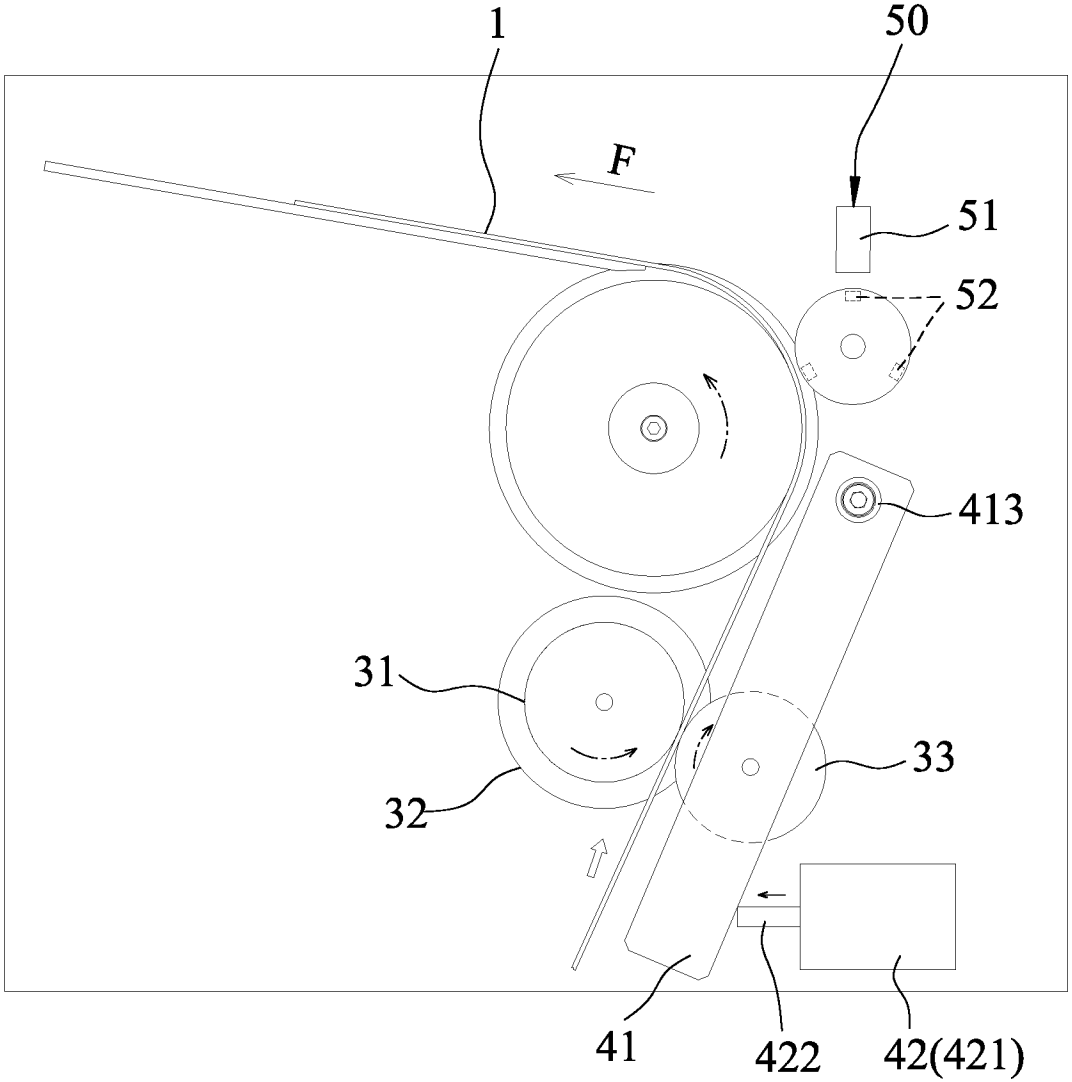
FIG. 4 is a schematic side view of the embodiment, illustrating a main feeding unit and the auxiliary feeding unit cooperating to feed the strap.

Afterwards, as illustrated in FIG. 4, to feed the strap 1 in the forward direction (F) again, the first and second driving rollers 21, 31 are driven to rotate in the first direction. As soon as the strap 1 is clamped between the first driving roller 21 and the first driven roller 23, the first driven roller 23 starts to rotate and such rotation is detected by the control device 51. Then, the actuating member 42 is deactivated by the control device 51 and thus the lever 41 is moved back to the position shown in FIGS. 1 and 2 so that the second driven roller 33 is moved from the contact position to the released position.

To sum up, by virtue of the detecting unit 50 that activates and deactivates the actuating member 42 according to rotation of the first driven roller 23, the strap 1 to be fed or to be returned is clamped between the first driving roller 21 and the first driven roller 23 of the main feeding unit 20 or between the second driving roller 31 and the second driven roller 33 at any time during use and would not fall down by gravity. In this way, the strapping machine equipped with the strap feeding device of the present disclosure can be operated smoothly.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A strap feeding device for a strapping machine adapted to feed a strap in a forward direction and to return the strap in a rearward direction when a strap feeding action is failed, comprising:

a base seat;

a main feeding unit including a first driving roller rotatably mounted on said base seat, a first driving element connected to said first driving roller and operable for driving said first driving roller to rotate, and a first driven roller rotatably mounted on said base seat and adapted for cooperation with said first driving roller to clamp the strap therebetween so as to move the strap when said first driving roller rotates;

an auxiliary feeding unit disposed at upstream of the main feeding unit and including a second driving roller rotatably mounted to said base seat, a second driving element connected to said second driving roller and operable for driving said second driving roller to rotate, and a second driven roller adjacent to said second driving roller;

an actuating unit including a lever having a pivot end that is pivotally mounted on said base seat, and a movable portion that is mounted with said second driven roller, and an actuating member operable to drive said lever to pivot relative to said base seat so as to move said second driven roller between a released position, where said second driven roller is spaced apart from said second driving roller, and a contact position, where said second driven roller is in contact with said second driving roller and is co-rotatable with said second driving roller; and a detecting unit mounted to said base seat, adjacent to said main feeding unit, and including a control device electrically connected to said first driving element, said second driving element and said actuating unit, and configured to control said first driving element for driving said first driving roller to rotate in a first direction and a second direction opposite to the first direction so as to feed and return the strap and control said second driving element for driving said second driving roller wheel to rotate in the first direction and the second direction so as to feed and return the strap, and a plurality of sensors adjacent to said first driven roller, and electrically connected to said control device for detecting rotation of said first driven roller, wherein said control device is configured to control said actuating unit to drive said lever to move said second driven roller to the contact position when said sensors detects that rotation of said first driven roller is stopped, and to control said actuating unit to move said second driven roller to the released position when said sensors detects that said first driven roller starts to rotate.

2. The strap feeding device as claimed in claim 1, wherein said actuating unit is a solenoid valve.

3. The strap feeding device as claimed in claim 1, wherein said actuating member is activatable to push and move said second driven roller to contact said second driving roller, and said actuating unit further includes a biasing member for biasing said second driven roller away from said second driving roller when said actuating member is deactivated.

4. The strap feeding device as claimed in claim 3, wherein said biasing member is a torsion spring.

5. The strap feeding device as claimed in claim 1, wherein said actuating member includes a cylinder and a push rod mounted movably to said cylinder and movable to push and rotate said lever relative to said base seat so as to move said second driven roller from the released position to the contact position, said lever being inclined such that a free end of said lever is pivoted by virtue of gravity to contact an end of said push rod so that said second driven roller is moved to the released position when said actuating member is deactivated.

* * * * *